US007508135B2

(12) United States Patent
Kang et al.

(10) Patent No.: US 7,508,135 B2
(45) Date of Patent: Mar. 24, 2009

(54) PLASMA DISPLAY PANEL

(75) Inventors: Kyoung-Doo Kang, Suwon-si (KR); Won-Ju Yi, Suwon-si (KR); Jae-Ik Kwon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 587 days.

(21) Appl. No.: 11/105,561

(22) Filed: Apr. 14, 2005

(65) Prior Publication Data

US 2005/0231113 A1 Oct. 20, 2005

(30) Foreign Application Priority Data

Apr. 19, 2004 (KR) ..... 10-2004-0026646

(51) Int. Cl.
*H01J 17/49* (2006.01)

(52) U.S. Cl. ..... 313/582; 313/581; 313/583; 313/584; 313/585; 313/586

(58) Field of Classification Search ..... 313/581–586
See application file for complete search history.

(56) References Cited

U.S. PATENT DOCUMENTS

| | | | | |
|---|---|---|---|---|
| 4,176,297 | A | 11/1979 | Thistle et al. | |
| 5,004,950 | A | 4/1991 | Lee | |
| 5,229,685 | A | 7/1993 | Kim et al. | |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,744,909 | A * | 4/1998 | Amano | 313/585 |
| 5,786,794 | A | 7/1998 | Kishi et al. | |

(Continued)

FOREIGN PATENT DOCUMENTS

| | | |
|---|---|---|
| JP | 02-148645 | 6/1990 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Nimeshkumar D. Patel
*Assistant Examiner*—Thomas A Hollweg
(74) *Attorney, Agent, or Firm*—Robert E. Bushnell, Esq.

(57) ABSTRACT

A plasma display panel (PDP) that has a front substrate, a rear substrate arranged opposite to the front substrate, closed-type front barrier ribs arranged between the front substrate and the rear substrate and formed of a dielectric material, the front barrier ribs defining discharge cells together with the front and rear substrates, front and rear discharge electrodes arranged within the front barrier ribs and surrounding the discharge cells and spaced apart from each other, phosphor layers arranged within the discharge cells and a discharge gas injected into discharge cells.

20 Claims, 8 Drawing Sheets

U.S. PATENT DOCUMENTS

| | | | | |
|---|---|---|---|---|
| 5,825,128 | A | 10/1998 | Betsui et al. | |
| 5,952,782 | A | 9/1999 | Nanto et al. | |
| 6,069,446 | A | 5/2000 | Kim | |
| RE37,444 | E | 11/2001 | Kanazawa | |
| 6,414,435 | B1 * | 7/2002 | Akiba | 313/584 |
| 6,630,916 | B1 | 10/2003 | Shinoda | |
| 6,707,436 | B2 | 3/2004 | Setoguchi et al. | |
| 6,815,890 | B2 * | 11/2004 | Tsai et al. | 313/584 |
| 2004/0027068 | A1 | 2/2004 | Chien et al. | |

FOREIGN PATENT DOCUMENTS

| | | |
|---|---|---|
| JP | 08-045433 | 2/1996 |
| JP | 10106437 | 4/1998 |
| JP | 2845183 | 10/1998 |
| JP | 2917279 | 4/1999 |
| JP | 2001-043804 | 2/2001 |
| JP | 2001-057155 | 2/2001 |
| JP | 2001143625 | 5/2001 |
| JP | 2001-325888 | 11/2001 |

OTHER PUBLICATIONS

European Office Action issued by the European Patent Office in applicant's corresponding European Patent Application No. EP 05103078, issued on Jul. 29, 2005.

* cited by examiner

PLASMA DISPLAY PANEL

CLAIM OF PRIORITY

This application makes reference to, incorporates the same herein, and claims all benefits accruing under 35 U.S.C. §119 from an application entitled PLASMA DISPLAY PANEL filed with the Korean Industrial Property Office on 19 Apr. 2004 and there duly assigned Serial No. 2004-0026646.

BACKGROUND OF THE INVENTION

1. Field of the Invention

The present invention relates to a plasma display panel having an improved structure.

2. Description of the Related Art

A plasma display panel (PDP) is a slim and light flat display panel that has a large size, high definition and wide viewing angle. Compared with other flat panel displays, the PDP can be easily manufactured to have a large size and the PDP is thus considered to be next-generation large flat panel display.

The PDP is classified into a DC type, an AC type, and a hybrid type according to the discharge voltage characteristics. Also, the PDP can be classified into an opposite discharge type and a surface discharge type according to the discharge structure.

Turning now to FIG. 1, FIG. 1 is a perspective view of a triode surface discharge PDP 100. In FIG. 1, the triode surface discharge PDP 100 includes a scan electrode 106, a common electrode 107, a bus electrode 108, a dielectric layer 109 covering these electrodes, and an MgO layer 111 covering the dielectric layer 109 and located on a front substrate 101. However, with the design of FIG. 1, because visible light generated from the phosphor layer 110 must travel through the front substrate 101 to be viewed, much of the visible light generated in the display is never seen. Unfortunately, the scan electrode 106, the common electrode 107, the bus electrode 108, the dielectric layer 109 and the MgO layer 111 formed on the front substrate 101 absorbs much (about 40%) of this generated visible light so that a large fraction of the visible light generated is never viewed. This absorbing by the scan electrode 106, the common electrode 107, the bus electrode 108, the dielectric layer 109 and the MgO layer 111 on the front substrate results in a low luminous efficiency, which is undesirable.

Another problem with the design of FIG. 1 is that when the PDP 100 displays the same image for along time, the phosphor layer 110 is ion sputtered by charged particles of a discharge gas, thus causing a permanent image sticking or image burn in. Therefore, what is needed is a design for a PDP that overcomes these problems of low luminous efficiency and image burn in.

SUMMARY OF THE INVENTION

It is therefore an object of the present invention to provide an improved design for a PDP.

It is further an object of the present invention to provide a design for a PDP that results in improved luminous efficiency.

It is still an object of the present invention to provide a design for a PDP that avoids the problem of image sticking or image burn in when the same image is displayed for a long period of time.

These and other objects can be achieved by a design for a PDP that includes a front substrate, a rear substrate arranged opposite to the front substrate, closed-type front barrier ribs arranged between the front substrate and the rear substrate and made of a dielectric material, the front barrier ribs defining discharge cells together with the front and rear substrates, front and rear discharge electrodes being arranged within the front barrier ribs and surrounding the discharge cells and spaced apart from each other, phosphor layers arranged within the discharge cells, and a discharge gas injected into the discharge cells.

The discharge cell may have a cross section of a circular shape. The front and rear discharge electrodes may include a loop portion having a predetermined width and a circular cross section and surrounding the discharge cell. Also, the front and rear discharge electrodes may include a loop portion having a predetermined width and a polygonal-shaped cross section and surrounding the discharge cell, where the ratio R of the minimum distance to a maximum distance from a symmetry axis of the loop portion of the front discharge electrode or the rear discharge electrode to the front discharge electrode satisfies the inequality $1.0/\sqrt{2} \leqq R \leqq 1.0$.

The front and rear discharge electrodes may include a rectangular loop portion surrounding the discharge cell, and a ratio of a length of a vertical portion to a length of a horizontal portion in the loop portion may be between 0.9 and 1.5.

According to the present invention, the interference of the electric field occurring in the front and rear discharge electrodes can be minimized, and a uniform discharge can be generated, thus improving the luminous efficiency. Also, since there are no electrons at portions of the front substrate where visible rays emitted from the discharge cell pass, an opening ratio and a transmittance can be remarkably improved. In addition, since the surface discharge occurs in all sides forming the discharge space, the discharge surface can be greatly extended.

Further, since the discharge is generated at the sides of the discharge cell and then spread toward the central portion of the discharge cell, the entire discharge cell can be efficiently used. Accordingly, the PDP can be driven at a low voltage, such that the luminous efficiency is remarkably improved. Furthermore, since the PDP can be driven at a low voltage even when a high-concentration Xe gas is present as discharge gas, the luminous efficiency can be improved.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 2:
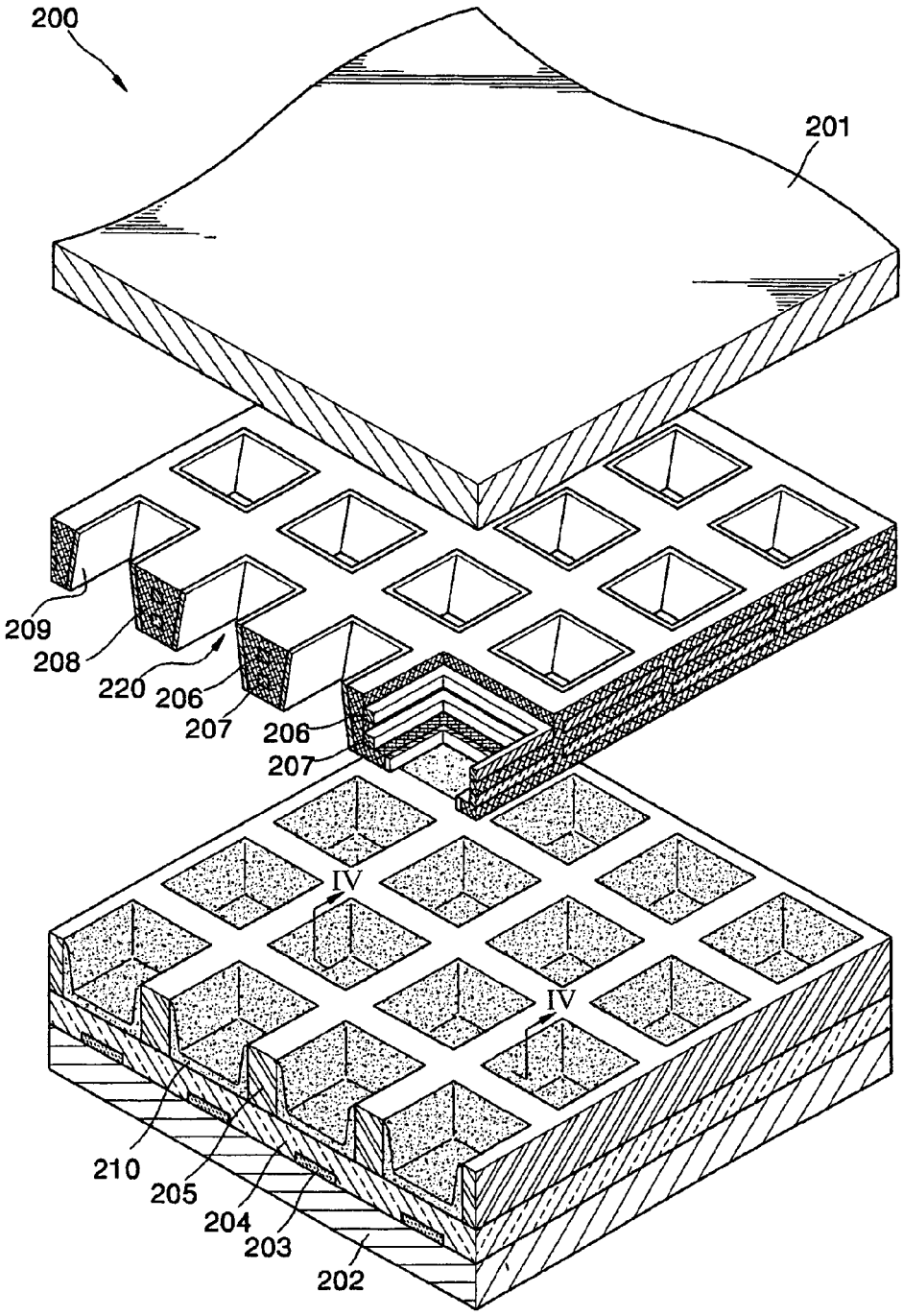
FIG. 2 is a partial cut-away exploded perspective view of a PDP according to a first embodiment of the present invention.

The PDP 200 according to the first embodiment of the present invention will now be described in conjunction with FIGS. 2 through 6. As illustrated in FIG. 2, PDP 200 includes a front substrate 201, a rear substrate 202 positioned in parallel to the front substrate 201, front barrier ribs 208 located between the front substrate 201 and the rear substrate 202 and formed of a dielectric material, the front barrier ribs 208 defining the discharge cells 220 together with the front and rear substrates 201 and 202, front and rear discharge electrodes 206 and 207 arranged within the front barrier ribs 208 to surround the discharge cells 220 and spaced apart from each other, phosphor layers 210 located within the discharge cells 220, and a discharge gas (not illustrated) injected into the discharge cells 220.

In this embodiment, since visible rays generated from the discharge cells 220 are emitted through the front substrate 201 to the outside, the front substrate 201 is formed of a material having good transmittance, such as glass. A front transmittance of visible rays is remarkably improved over the PDP 100 of FIG. 1 because the front substrate 201 does not have a scan electrode 106 and a common electrode 107 formed of indium tin oxide (ITO), a bus electrode 108 formed of metal, and a dielectric layer 109 covering the electrodes, which were present in the front substrate 101 of PDP 100 of FIG. 1. Accordingly, if an image is implemented to have a conventional brightness, the front and rear electrodes 206 and 207 are driven at a relatively low voltage, resulting in an increase of a luminous efficiency.

In the PDP 200 of FIG. 2, the front barrier ribs 208 are formed on a lower surface of the front substrate 201, and partition the discharge cells 220 corresponding to one subpixel among a red subpixel, a green subpixel and a blue subpixel. The front barrier ribs 208 also prevents crosstalk between neighboring discharge cells 220. The front barrier ribs 208 prevent the front and rear discharge electrodes 206 and 207 from being directly electrically connected together during a discharge, and prevent charged particles from directly colliding with the electrodes 206 and 207, so that the electrodes 206 and 207 can be protected. The front barrier ribs 208 are made of a dielectric material such as PbO, $B_2O_3$ or $SiO_2$, which can guide the charged particles to accumulated wall charges.

Referring to FIG. 2, due to the closed-type barrier ribs 208, the discharge cells 220 have a cross section of a square. However, the discharge cells can instead have various polygonal shapes, such as a regular pentagon and a regular hexagon. Also, the discharge cells can instead have a circular cross section.

Figure 3:
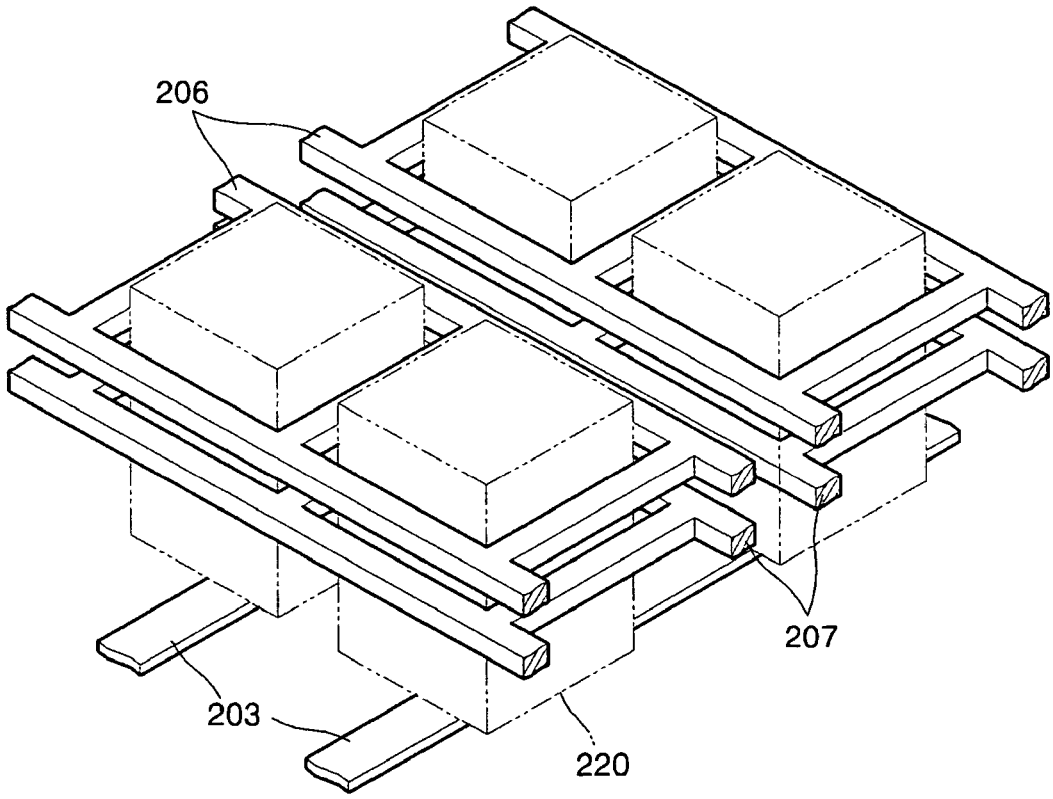
FIG. 3 is a perspective view of a discharge cell and electrodes illustrated in FIG. 2.

Turning now to FIG. 3, FIG. 3 illustrates in close up the electrode and discharge cell interrelationship for four discharge cells in the PDP 200 of FIG. 2. As illustrated in FIG. 3, the front and rear discharge electrodes 206 and 207 surrounding the discharge cells 220 are arranged in parallel with each other and in parallel to the front substrate 201. The front discharge electrode 206 is spaced apart from the rear discharge electrode 207 in a direction perpendicular to the front substrate 201. The front and rear discharge electrodes 206 and 207 extend along one row of discharge cells 220. The front and rear discharge electrodes 206 and 207 can be formed of a conductive metal, such as aluminum or copper.

The PDP 200 according to the first embodiment of the present invention may instead not include an address electrode 203. When there is no address electrode, the front discharge electrodes are extended along one direction, and the rear discharge electrode is extended in a direction intersecting with the extended direction of the front discharge electrodes. In this case, one of the front and rear discharge electrodes serves as the address electrode and the other serves as the scan electrode and the sustain electrode.

Figure 4:
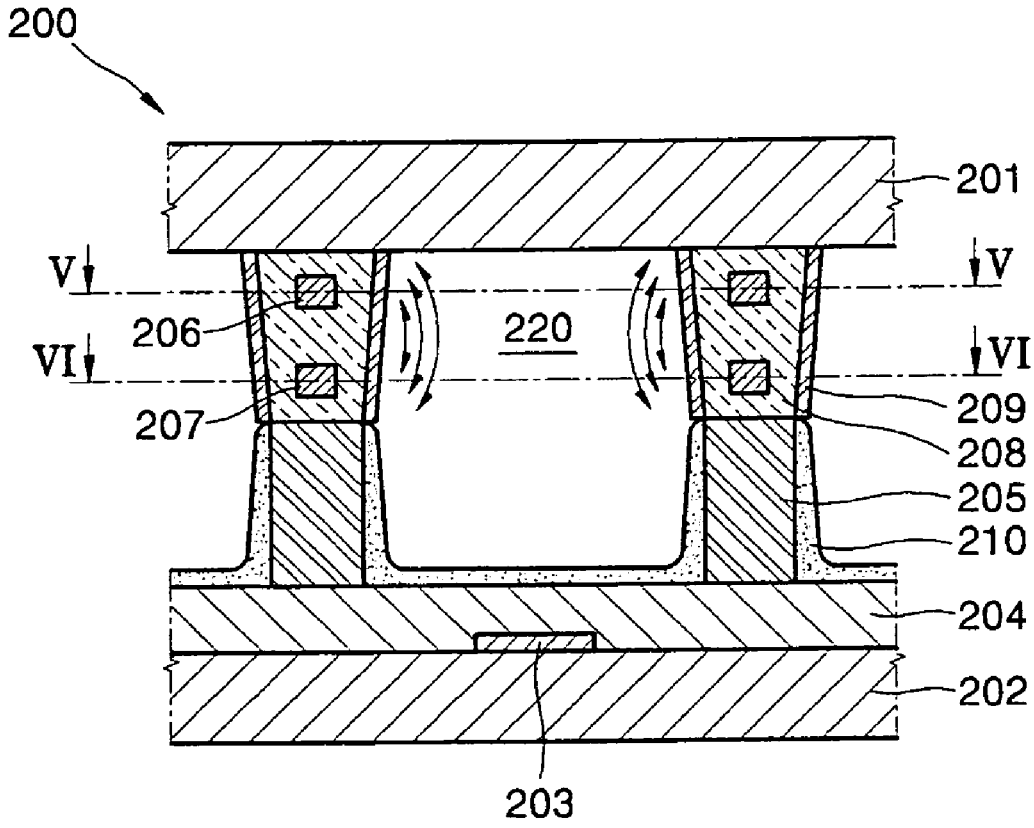
FIG. 4 is a sectional view taken along line IV-IV of FIG. 2.
Figure 5:
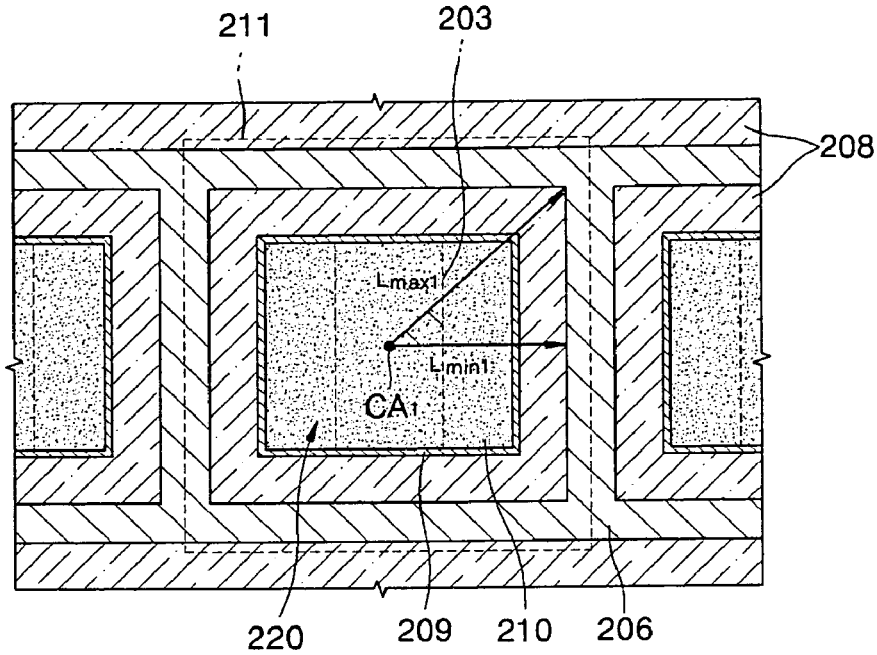
FIG. 5 is a sectional view taken along line V-V of FIG. 4.
Figure 6:
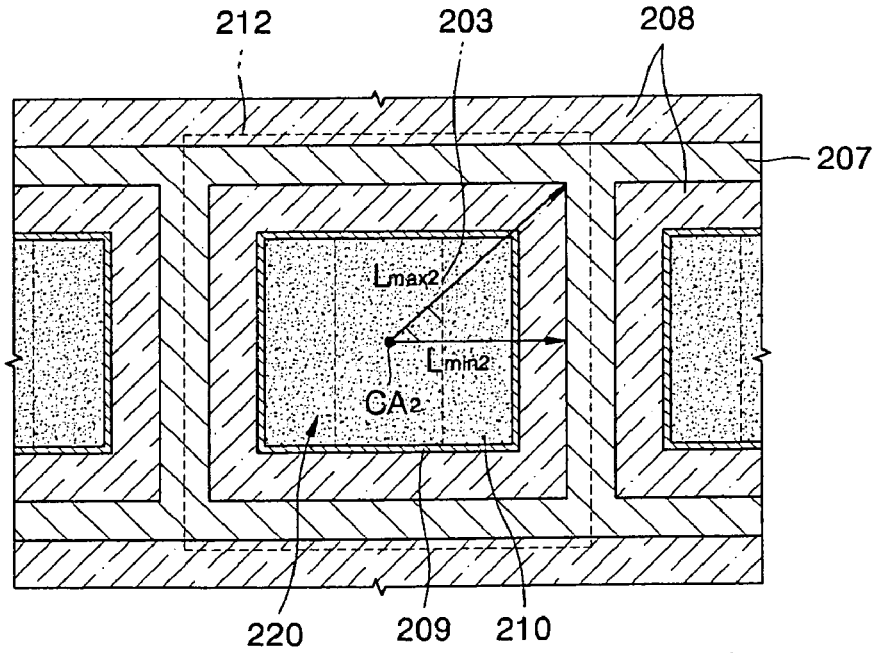
FIG. 6 is a sectional view taken along line VI-VI of FIG. 4.

Turning now to FIGS. 5 and 6, FIGS. 5 and 6 illustrated sectional views of the PDP 200 illustrated in FIGS. 2 and 4 taken along V-V and IV-IV respectively. Referring to FIGS. 5 and 6, the front and rear discharge electrodes 206 and 207 surround each discharge cells 220 and have a square shape. The front and the rear discharge electrodes extend to surround a plurality of discharge cells that are arranged in a row. The front and the rear discharge electrodes 206 and 207 include loop portions 211 and 212 respectively, each having a predetermined width. Loop portions 211 and 212 of the front and rear discharge electrodes respectively is a portion of the front and rear discharge electrodes 206 and 207 that surround each of the discharge cells 220 in the row. If a predetermined voltage is applied to the front and rear discharge electrodes 206 and 207 during the discharge, an electric field is formed in the discharge cells 220 by the front and rear discharge electrodes 206 and 207. The electric field is uniformly formed along sides of the discharge cells 220. Also, since less interference occurs between the opposite surfaces of the discharge cells 220, the discharge occurs uniformly within the discharge cell. Consequently, the luminous efficiency is improved by such an electrode arrangement.

In order to maximize the uniformity of the electric field and the luminous efficiency, it is preferable that the loop portions 211 and 212 of the front and rear discharge electrodes 206 and 207 both have a regular polygonal shape. Furthermore, if the cross sections of the discharge cells 220 and the loop portions of the front and rear discharge electrodes have a form close to a circular shape, the luminous efficiency is even more improved.

That is, in order to improve the luminous efficiency in a discharge cell whose cross section has a the regular polygonal shape, the loop portions of the front and rear discharge electrodes must be formed to have a form closer to a circular shape. Turning to FIG. 5, FIG. 5 illustrates one loop of a front discharge electrode 206. As can be seen in FIG. 5, $CA_1$ is the center of symmetry for the front discharge electrode 206. A minimum distance $L_{min1}$ is the minimum distance from the symmetry axis $CA_1$ to a portion of the front discharge electrode. $L_{max1}$ is a maximum distance from the axis of symmetry $CA_1$ to the front discharge electrode 206. In the present invention, $L_{min1}$ $L_{max1}$ and the ratio $R_1$ of $L_{min1}$ to $L_{max1}$ can be considered as a design parameter for the shape of the loop portion.

Likewise, FIG. 6 illustrates one loop of a rear discharge electrode 207. As can be seen in FIG. 6, $CA_2$ is the axis of symmetry for the rear discharge electrode 207, $L_{min2}$ is the minimum distance from $CA_2$ to the rear discharge electrode 207 and $L_{max2}$ is the maximum distance from $CA_2$ to the rear discharge electrode 207. Ratio $R_2$ is the ratio of the minimum distance $L_{min2}$ to the maximum distance $L_{max2}$. As with the front discharge electrode 206, $L_{min2}$, $L_{max2}$ and $R_2$ for the rear discharge electrodes 207 are also design parameters.

In general, considering the opening ratio of the PDP, if the loop portion has a regular polygonal shape with four or more edges, the interference of the electric field occurring between the discharge electrodes is small and the opening ratio increases. A ratio R for a square loop is $1/\sqrt{2}$, a ratio of the regular hexagonal loop is $\sqrt{3}/2$, and a ratio of the circular loop is 1. Accordingly, as the regular polygonal shape gets closer to that of a circle, the ratio R decreases and the ratio of a circular loop becomes 1. Thus, it is preferable that the ratio $R_1=(L_{min1}/L_{max1})$ of the front discharge electrode 206 satisfies the inequality $1/\sqrt{2} \leqq L_{min1}/L_{max1} \leqq 1.0$. Likewise, it is preferable that the ratio $R_2=(L_{min2}/L_{max2})$ of the rear discharge electrode 207 satisfies the inequality $1/\sqrt{2}L_{min1}/L_{max1} \leqq 1.0$. However, considering the process error in the formation of the front and rear discharge electrodes 206 and 207, it is preferable that the ratio $R_1=(L_{min1}/L_{max1})$ of the front discharge electrode 206 satisfies the inequality $1.1/\sqrt{2} \leqq L_{min1}/L_{max1} \leqq 1.0$ and the ratio $R_2=(L_{min2}/L_{max2})$ of the rear discharge electrode 207 satisfies the inequality $1.1/\sqrt{2} \leqq L_{min2}/L_{max2} \leqq 1.0$.

In this embodiment, the loop portion 211 of the front discharge electrode 206, the loop portion 212 of the rear discharge electrode 207, and the discharge cells 220 have the same cross section. However, the present invention is not limited to this. That is, the loop portion 211 of the front discharge electrode 206, the loop portion 212 of the rear discharge electrode 207, and the discharge cells 220 can also have different cross sections. Meanwhile, if the loop portion 211 of the front discharge electrode 206, the loop portion 212 of the rear discharge electrode 207, and the discharge cell 200 each have the same cross section, the uniformity of the discharge is improved so that the luminous efficiency increases.

It is preferable that at least sides of the front barrier ribs 208 are covered with the MgO layer 209 that serves as a protective layer. The MgO layer 209 can be formed by a deposition process at the front barrier ribs, lower surfaces of the front barrier ribs, and/or a lower surface of the front substrate between the discharge cells. Although the MgO layer 209 is not a requisite component, its presence can prevent the barrier ribs 208 from being damaged due to collision with charged particles. Also, the presence of the MgO layer 209 is beneficial for another reason because the MgO layer 209 emits a lot of secondary electrons during the discharge.

The rear substrate 202 supports the address electrodes 203 and the dielectric layer 204 and is made of a material whose main component is a glass. On the rear substrate 202, the address electrodes 203 are arranged. The address electrodes 203 each extend along one row of discharge cells in a direction intersecting the direction the front and rear discharge electrodes 206 and 207 extend. In this embodiment, the address electrodes 203 are formed to be orthogonal to the front and rear discharge electrodes 206 and 207.

The address electrodes 203 initiate an address discharge that makes it easier to initiate a sustain discharge between the front discharge electrode 206 and the rear discharge electrode 207. That is, the address electrode 203 reduces the voltage needed to initiate the sustain discharge. The address discharge occurs between the scan electrode and the address electrode. When the address discharge is finished, positive ions accumulate near the scan electrode and electrons accumulate near the common electrode. Thus, the sustain discharge between the scan electrode and the common electrode can occur more easily than if no charges accumulated.

Since an address discharge occurs most efficiently when the gap between the scan electrode and the address electrode small, the rear discharge electrode 207 is located closer to the address electrode 203 than the front discharge electrode 206. The rear discharge electrode serves as the scan electrode and the front discharge electrode 206 serves as the common electrode. However, even when there is no address electrode 203 present on the rear substrate, the discharge can occur between the front and rear discharge electrodes 206 and 207. Therefore, the present invention is not limited to the structure where address electrodes 203 are present.

The dielectric layer 204 where the address electrode 203 is buried is made of a dielectric material such as PbO, $B_2O_3$ and $SiO_2$. Such materials can guide charges and also prevent damage to the address electrode 203 caused by collision of positive ions or electrons during the discharge.

The rear barrier ribs 205 are arranged between the front barrier ribs 208 and the dielectric layer 204 and define a space therebetween. Although the rear barrier ribs 205 define a square matrix shape in the PDP 200 of FIG. 2, the present invention is not limited to this structure. That is, the front and rear barrier ribs 208 and 205 can be made to have the same shape or can differ in shape from each other. The front and rear barrier ribs 208 and 205 may be formed integrally or separately. Here, the integral formation means that the barrier ribs 208 and 205 are formed so they do not separate from each other easily.

Although the phosphor layers 210 illustrated in FIGS. 2 and 4 are arranged on the sides of the rear barrier ribs 205 and on the dielectric layer 204, the present invention is not limited to this arrangement. The phosphor layers 210 receive ultraviolet rays produced by the discharge. The phosphor layers formed at the red subpixel contain a phosphor such as $Y(V,P)O_4$:Eu, the phosphor layers formed at the green subpixel contain a phosphor such as $Zn_2SiO_4$:Mn and $YBO_3$:Tb, and the phosphor layers formed at the blue subpixel contain a phosphor such as BAM:Eu.

The discharge cells 220 are filled with a discharge gas, such as Ne, Xe or a mixture thereof. According to the present invention, the discharge surface can be increased and the discharge area can be extended so that an amount of plasma increases. Therefore, low voltage driving is possible. Since the present invention can achieve low voltage driving even when a high-concentration Xe gas is used as the discharge gas, the luminous efficiency can be remarkably improved. Consequently, the present invention can solve the problem of the PDP 100 of FIG. 1 where the low voltage driving is difficult when a high-concentration Xe gas is used as the discharge gas.

In the above-described PDP 200, the address discharge is initiated by applying a potential difference between the address electrode 203 and the rear discharge electrode 207. As a result of the address discharge that occurs as a result of this potential difference, the discharge cells 220 for the sustain discharge is selected.

Thereafter, an AC sustain voltage is applied between the front discharge electrode 206 and the rear discharge electrode 207 of the selected discharge cells 220. This causes a sustain discharge to occur therebetween. Due to the sustain discharge, an energy level of the excited discharge gas is lowered and thus ultraviolet rays are emitted. The ultraviolet rays excite the phosphor layer 210 located within the discharge cells 220 and the energy level of the excited phosphor layer 210 is lowered thus emitting visible rays that form an image.

Figure 1:
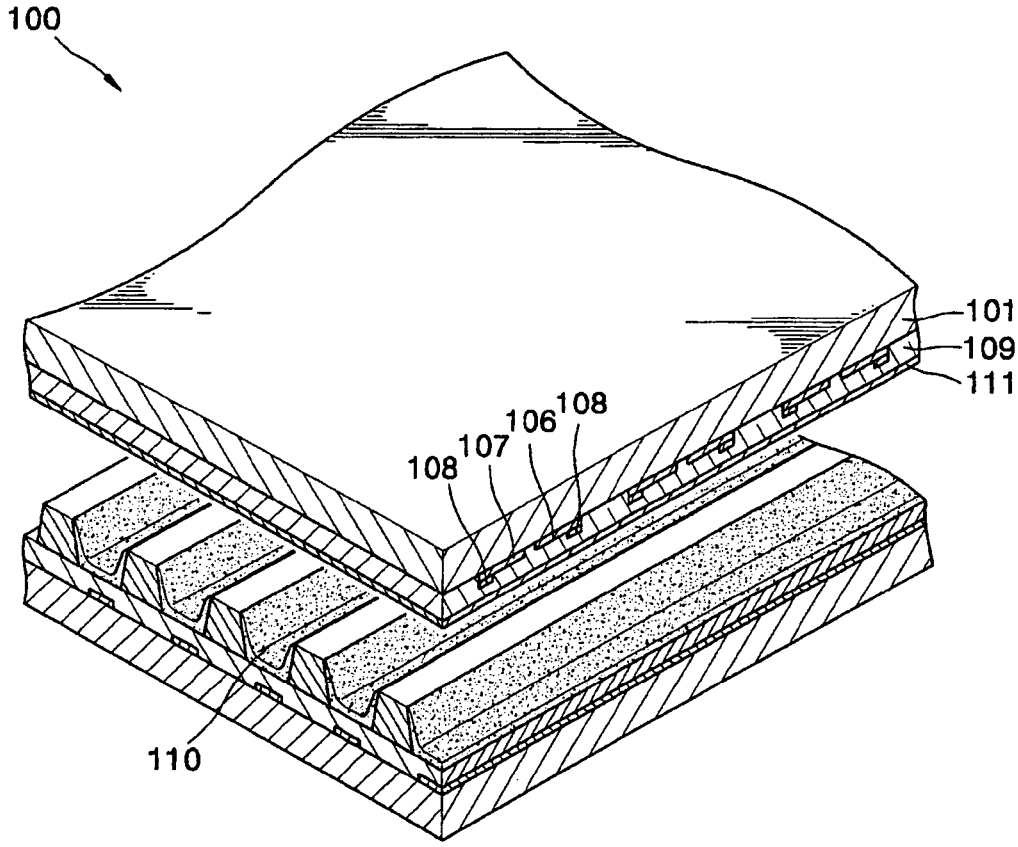
FIG. 1 is an exploded perspective view of a PDP.

According to the PDP 100 illustrated in FIG. 1, the sustain discharge between the scan electrode 106 and the common electrode 107 occurs in a horizontal direction, so that the discharge area is relatively narrow. However, according to the present invention, the sustain discharge of the PDP 200 is initiated at all sides defining the discharge cells, so that the discharge area is relatively wide.

Also, the sustain discharge is formed in a closed curve along the sides of the discharge cells 220 and is gradually spread toward the center of the discharge cells 220. Thus, a volume of space where the sustain discharge occurs is increased compared to the PDP 100 of FIG. 1, and the space charges unused in the PDP 100 of FIG. 1 can contribute to the discharge in the PDP 200 according to the present invention. This results in improved luminous efficiency for the PDP 200 designed according to the present invention.

As illustrated in FIG. 4, the sustain discharge occurs only in the area near the front barrier ribs 208. Since the phosphor layer 210 is not located in this portion of the discharge cells 220 but in the portion near the rear barrier rib 205 and on the dielectric layer 204, the ion sputtering of the phosphor layer by charged particles can be prevented and permanent image sticking will not occur when the same image is displayed for a long period of time.

Figure 7:
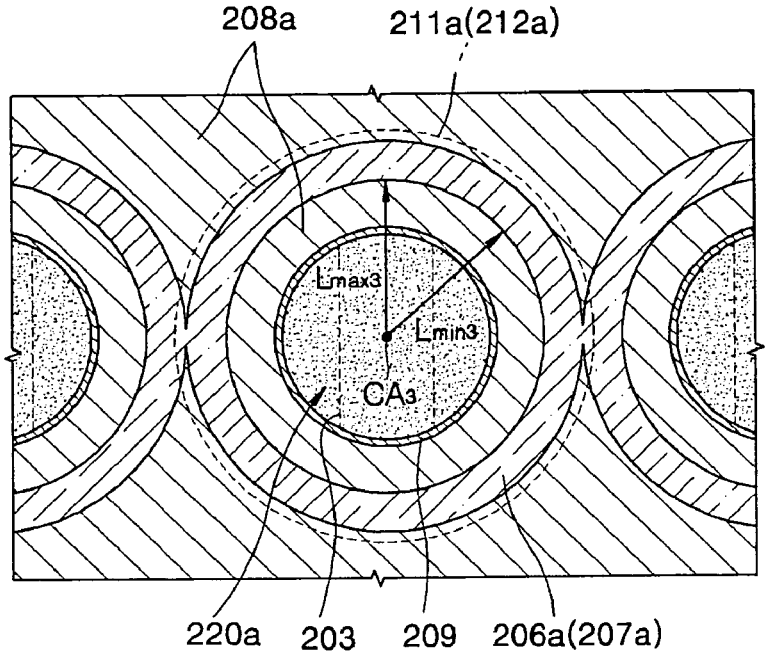
FIG. 7 is a sectional view of a first modification of the first embodiment of the present invention.
Figure 8:
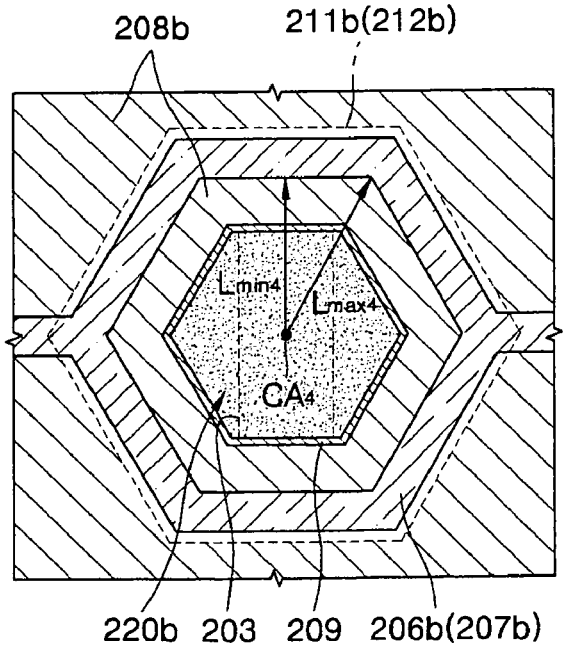
FIG. 8 is a sectional view of a second modification of the first embodiment of the present invention.

Turning now to FIGS. 7 and 8, FIGS. 7 and 8 illustrate first and second modifications respectively of the first embodiment of the present invention where the shapes or cross-sections of the discharge cells, the barrier ribs and the front and rear discharge electrodes take on different shapes. In FIG. 7, the front barriers 208*a* are formed so that the discharge cells have a circular cross section, and the front and rear discharge electrodes 206*a* and 207*a* have circular loop portions 211*a* and 212*a*. In FIG. 8, the front barrier ribs 208*b* are formed so that the discharge cells 220*a* have a regular hexagonal shaped cross section, and the front and rear discharge electrodes 206*b* and 207*b* have regular hexagonal loop portions 211*b* and 212*b*.

As with the PDP 200 of FIG. 2, the front and the rear discharge electrodes 206*a* (206*b*) 207*a* (207*b*) in these two modifications extend to surround a plurality of discharge cells 220 that are arranged in a row. The front and the rear discharge electrodes 206*a* (206*b*) 207*a* (207*b*) in these modifications include loop portions 211*a* (211*b*) and 212*a* (212*b*) respectively, each having a predetermined width. Loop portions 211*a* (211*b*) and 212*a* (212*b*) of the front and rear discharge electrodes 206*a* (206*b*) and 207*a* (207*b*) respectively is a portion of the front and rear discharge electrodes 206*a* (206*b*) and 207*a* (207*b*) that surround each of the discharge cells 220 in the row.

Compared with the PDP 200 of FIG. 2, a difference of the first modification of FIG. 7 is that the cross section of the discharge cells 220*a* and the shapes of the loop portions 211*a* and 212*a* of the front and rear discharge electrodes 206*a* and 207*a* are circular and not square. In FIG. 7, the central axis of symmetry is $CA_3$, the minimum distance from $CA_3$ to the front discharge electrode is $L_{min3}$ and the maximum distance from $CA_3$ to the front discharge electrode 206*a* is $L_{max3}$. As in FIGS. 5 and 6, the ratio $R_3=(L_{min3}/L_{max3})$. With a circular cross section as in FIG. 7, this ratio $R_3$ is equal to unity (1). This results in a reduction of interference of the electric field occurring in the front discharge electrode 206*a*. Likewise, since the rear discharge electrode 207*a* has the circular loop portion 212*a*, the interference of the electric field occurring in the rear discharge electrode 207*a* is also reduced. Accordingly, a discharge is uniformly generated, thus improving the luminous efficiency.

The second modification of FIG. 8 is similar to the first modification, except that the cross section of the discharge cell and the shapes of the loop portions 211*b* and 212*b* of the front and rear discharge electrodes 206*b* and 207*b* have the form of a regular hexagon. As illustrated in FIG. 8, $CA_4$ is the central axis of symmetry, $L_{min4}$ is the minimum distance between $CA_4$ and the front discharge electrode 206*b*, and $L_{max4}$ is the maximum distance between $CA_4$ and the front discharge electrode 206*b*. In FIG. 8, the ratio $R_4=(L_{min4}/L_{max4})$ is $\sqrt{3}/2$, and the interference of the electric field occurring in the front discharge electrode 206*b* is thus reduced. Likewise, since the rear discharge electrode 207*b* has the loop portion 212*b* of a regular hexagon form, the interference of the electric field occurring in the rear discharge electrode 207*b* is also reduced. Accordingly, a discharge is uniformly generated, thus improving the luminous efficiency.

Figure 9:
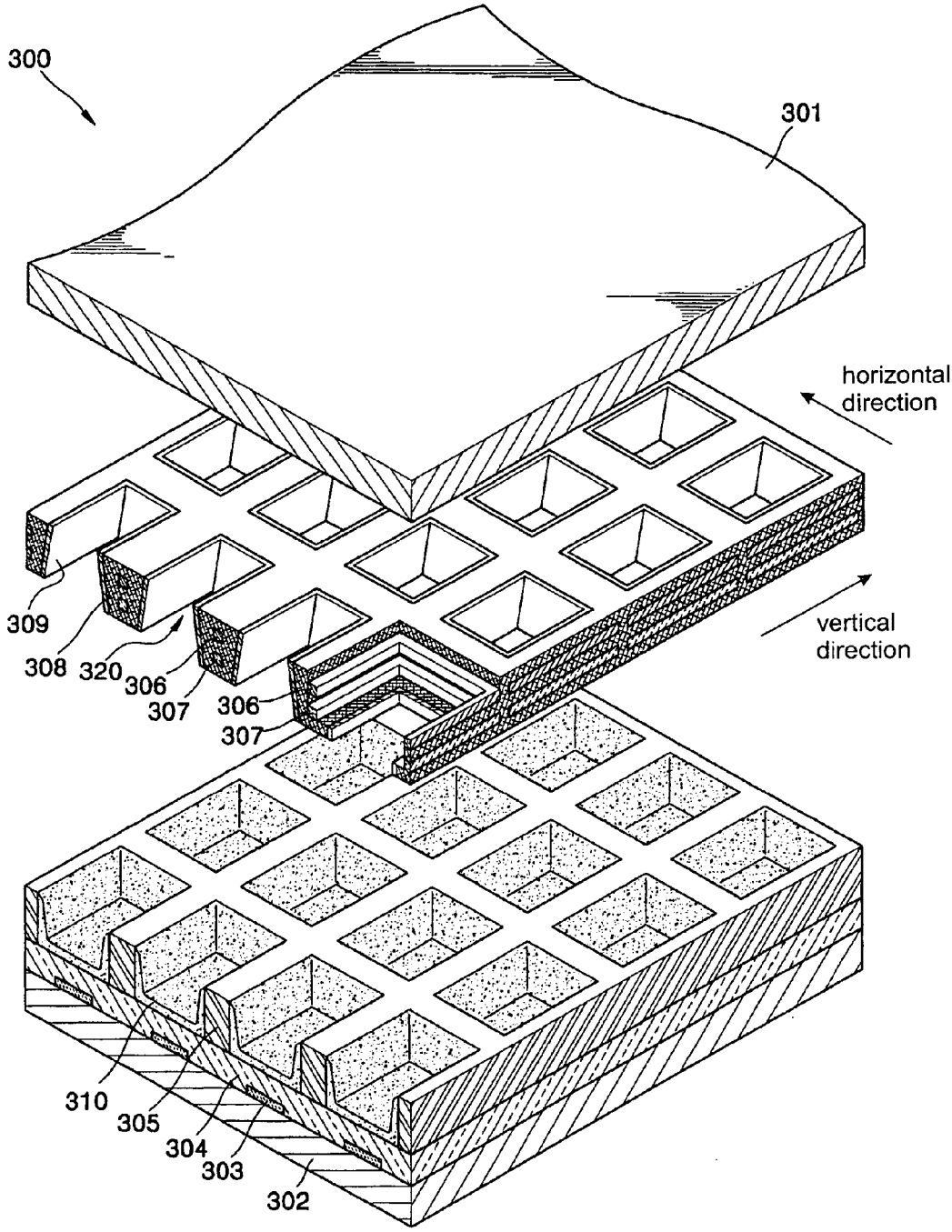
FIG. 9 is a partial cut-away exploded perspective view of a PDP according to a second embodiment of the present invention.
Figure 10:
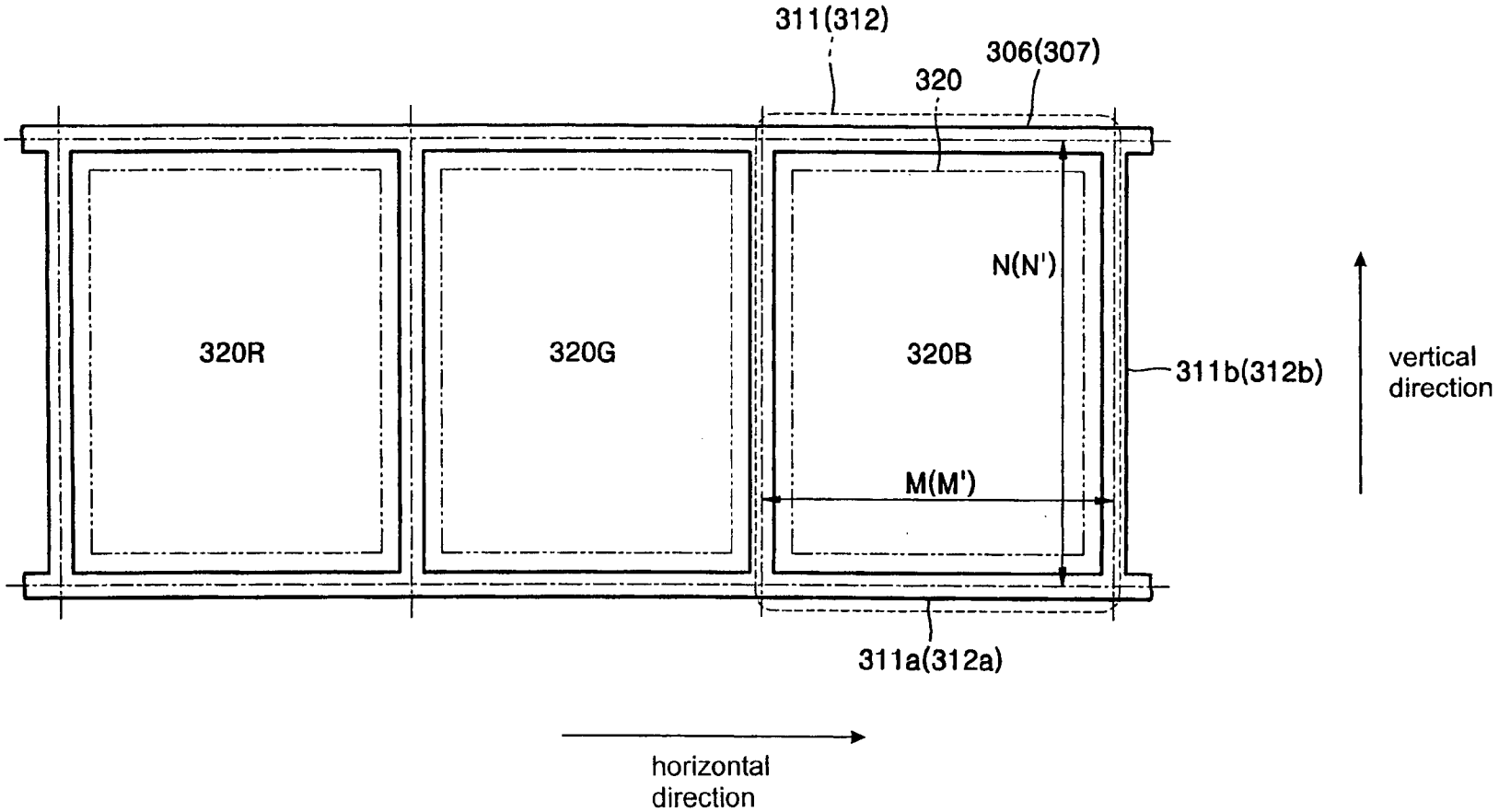
FIG. 10 is a plan view of a discharge cell and electrodes illustrated in FIG. 9.

Turning now to FIGS. 9 and 10, FIGS. 9 and 10 illustrate a PDP 300 according to a second embodiment of the present invention. PDP 300 includes a front substrate 301, a rear substrate 302 located in parallel to the front substrate 301, front barrier ribs 308 located between the front substrate 301 and the rear substrate 302 and formed of a dielectric material, the front barrier ribs 308 defining R, G and B discharge cells 320R, 320G and 320B together with the front and rear substrates 301 and 302, front and rear discharge electrodes 306 and 307 arranged within the front barrier ribs 308 and surrounding the discharge cells 320 and spaced apart from each other, rear barrier ribs 305 arranged between the front barrier ribs 308 and the rear substrate 302, phosphor layers 310 located within the discharge cells 320, a protective layer 309 formed on the sides of the front barrier ribs 308, address electrodes 303 arranged on the rear substrate 302, a dielectric layer 304 covering the address electrodes 303, and a discharge gas (not illustrated) filling the discharge cells 320. Since structures and operations of the front substrate 301, the rear substrate 302, the protective layer 309, the address electrode 303, the phosphor layer 310 and the dielectric layer 304 are equal or similar to those of the first embodiment, a description thereof will be omitted.

The PDP 300 according to the second embodiment differs from PDP 200 according to the first embodiment in that the discharge cells 320 have a cross section of a rectangular shape instead of a square shape. Referring to FIG. 10, the front discharge electrode 306 has loop portion 311 having a predetermined width and a cross section of a rectangular shape surrounding the discharge cells 320.

As described in the first embodiment, in order to uniformly produce the discharge in the discharge cells 320 and increase the luminous efficiency, it is preferable that the loop portions 311 of the front discharge electrodes have a shape close to a square. Accordingly, in order to maximize the luminous efficiency in the discharge cells 320 having the cross section of the rectangular shape, a horizontal portion 311*a* and a vertical portion 311*b* constituting each loop portion 311 of the front discharge electrode 306 is formed to have a shape close to that of a square. A ratio (N/M) of a length N of the vertical portion 311*b* to a length M of the horizontal portion 311*a* in the loop portion 312 of the front discharge electrode 306 can be considered as a design parameter.

It is preferable that a ratio (N/M) of a length N of the vertical portion 311*a* to a length M of the horizontal portion 311*a* in the loop portion 311 of the rear discharge electrode 307 is in range from 0.9 to 1.5. Likewise, a ratio (N'/M') of a length N' of the vertical portion 312*b* to a length M' of the horizontal portion 312*b* in a loop portion 312 of the rear discharge electrode 307 is also preferably in range of 0.9 to 1.5.

In this second embodiment, although the loop portion 311 of the front discharge electrode 306, the loop portion 312 of the rear discharge electrode 307, and the cross section of the discharge cells 320 are all illustrated as having the same rectangular shape, the present invention is in no way so Limited. That is, the loop portion 311 of the front discharge electrode 306, the loop portion 312 of the rear discharge electrode 307, and the cross section of the discharge cells 320 may be formed to have different shapes and still be within the scope of the present invention.

Meanwhile, if the loop portion 311 of the front discharge electrode 306, the loop portion 312 of the rear discharge electrode 307, and the cross section of the discharge cells 320 have the same cross section, the uniformity of the discharge is improved so that the luminous efficiency is increased. Since a driving method of the PDP 300 is similar to that of the first embodiment, a detailed description thereof will be omitted.

While the present invention has been particularly illustrated and described with reference to exemplary embodiments thereof, it will be understood by those of ordinary skill in the art that various changes in form and details maybe made therein without departing from the spirit and scope of the present invention as defined by the following claims.

What is claimed is:

1. A PDP (plasma display panel), comprising:

a front substrate;

a rear substrate arranged opposite to the front substrate;

a plurality of front barrier ribs arranged between the front substrate and the rear substrate and comprising a dielectric material, the front barrier ribs defining discharge cells together with the front and rear substrates;

rear barrier ribs arranged between the front barrier ribs and the rear substrate;

front and rear discharge electrodes arranged within the front barrier ribs and surrounding the discharge cells and spaced apart from each other;

phosphor layers arranged within the discharge cells, the phosphor layers being arranged on at least a side of the rear barrier ribs; and a discharge gas arranged within the discharge cells, each front discharge electrode includes a loop portion having a predetermined width, a cross section of the loop portion having a regular polygonal shape, the loop portion surrounding one of said discharge cells, a ratio R of a minimum distance to a maximum distance from a symmetry axis of a loop portion of a front discharge electrode to an inner side of the front discharge electrode satisfies the inequality $1.0/\sqrt{2} \leqq R \leqq 1$.

2. The PDP of claim 1, each discharge cell having a polygonal-shaped cross section, each of the front and rear discharge electrodes comprises a plurality of loop portions, each loop portion being polygonal-shaped.

3. The PDP of claim 1, each discharge cell having a regular polygonal-shaped cross section, each of the front and rear discharge electrodes comprises a plurality of loop portions, each loop portion being regular polygonal-shaped.

4. The PDP of claim 1, a ratio R of a minimum distance to a maximum distance from a symmetry axis of a loop portion of a front discharge electrode to an inner side of the front discharge electrode satisfies the inequality $1.1/\sqrt{2} \leqq R \leqq 1.0$.

5. The PDP of claim 1, each rear discharge electrode includes a loop portion having a predetermined width, a cross section of the loop portion having a polygonal shape, the loop portion surrounding one of said discharge cells.

6. The PDP of claim 1, each front discharge electrode includes a rectangular-shaped loop portion that surrounds a corresponding discharge cell, a ratio of a length of a vertical portion to a length of a horizontal portion in the loop portion being between 0.9 and 1.5.

7. The PDP of claim 1, each rear discharge electrode includes a rectangular-shaped loop portion that surrounds a corresponding discharge cell, a ratio of a length of a vertical portion to a length of a horizontal portion in the loop portion being between 0.9 and 1.5.

8. The PDP of claim 1, a portion of the front discharge electrode surrounding a discharge cell has a same shape as a cross section of the discharge cell.

9. The PDP of claim 1, a portion of the rear discharge electrode surrounding a discharge cell has a same shape as a cross section of the discharge cell.

10. The PDP of claim 1, each front discharge electrode extending in a first direction, and each rear discharge electrode extending in a second direction that intersects with the front discharge electrodes.

11. The PDP of claim 1, further comprising address electrodes extending along a direction intersecting with a direction that the front and rear discharge electrodes extend, the front and rear discharge electrodes being parallel to each other.

12. The PDP of claim 1, the phosphor layers being arranged between the address electrodes and the rear discharge electrodes.

13. The PDP of claim 1, further comprising:

a plurality of address electrodes arranged on the rear substrate; and a dielectric layer covering each of the plurality of the address electrodes.

14. The PDP of claim 1, further comprising a plurality of address electrodes arranged directly on a surface of the rear substrate that faces the front substrate.

15. The PDP of claim 1, the rear barrier ribs being closed-type rear barrier ribs, the front barrier ribs being closed-type barrier ribs the rear barrier ribs defining the discharge cells together with the closed-type front barrier ribs, the front substrate and the rear substrate.

16. The PDP of claim 1, the front barrier ribs being closed-type barrier ribs, the rear barrier ribs being of a same pattern as that of the close-type front barrier ribs.

17. The PDP of claim 1, wherein each of the front barrier ribs that extend in a first direction includes more than one of said front discharge electrodes and at least one of said rear discharge electrodes.

18. The PDP of claim 1, wherein each of the front barrier ribs that extend in a first direction includes two of said front discharge electrodes and two of said rear discharge electrodes, and wherein each of the front barrier ribs that extend in a second direction that crosses the first direction includes only one of said front discharge electrodes and only one of said rear discharge electrodes.

19. A PDP (plasma display panel), comprising:

a front substrate;

a rear substrate arranged opposite to the front substrate;

a plurality of front barrier ribs arranged between the front substrate and the rear substrate and comprising a dielectric material, the front barrier ribs defining discharge cells together with the front and rear substrates;

rear barrier ribs arranged between the front barrier ribs and the rear substrate;

front and rear discharge electrodes arranged within the front barrier ribs and surrounding the discharge cells and spaced apart from each other;

phosphor layers arranged within the discharge cells, the phosphor layers being arranged on at least a side of the rear barrier ribs; and a discharge gas arranged within the discharge cells, each rear discharge electrode includes a loop portion having a predetermined width, a cross section of the loop portion having a regular polygonal shape, the loop portion surrounding one of said discharge cells, a ratio R of a minimum distance to a maximum distance from a symmetry axis of a loop portion of a rear discharge electrode to an inner side of the rear discharge electrode satisfies the inequality $1.0/\sqrt{2} \leqq R \leqq 1.0$.

20. The PDP of claim 19, a ratio R of a minimum distance to a maximum distance from a symmetry axis of a loop portion of a rear discharge electrode to an inner side of the rear discharge electrode satisfies the inequality $1.1/\sqrt{2} \leqq R \leqq 1.0$.

* * * * *